US011703811B2

(12) United States Patent
Mitani

(10) Patent No.: US 11,703,811 B2
(45) Date of Patent: Jul. 18, 2023

(54) ELECTRONIC TIMEPIECE

(71) Applicant: Seiko Epson Corporation, Tokyo (JP)

(72) Inventor: Toshihiro Mitani, Matsumoto (JP)

(73) Assignee: SEIKO EPSON CORPORATION

( * ) Notice: Subject to any disclaimer, the term of this patent is extended or adjusted under 35 U.S.C. 154(b) by 930 days.

(21) Appl. No.: 16/584,989

(22) Filed: Sep. 27, 2019

(65) Prior Publication Data

US 2020/0103831 A1 Apr. 2, 2020

(30) Foreign Application Priority Data

Sep. 28, 2018 (JP) ..... 2018-183866

(51) Int. Cl.

| | |
|---|---|
| ***G04G 5/00*** | (2013.01) |
| ***G04R 20/04*** | (2013.01) |
| ***G04R 60/12*** | (2013.01) |
| *G04C 10/04* | (2006.01) |

(52) U.S. Cl.

CPC ..... *G04R 20/04* (2013.01); *G04R 60/12* (2013.01); *G04C 10/04* (2013.01)

(58) Field of Classification Search

CPC ..... G04R 20/04; G04R 60/12; G04G 5/002; G04G 5/00

See application file for complete search history.

(56) References Cited

U.S. PATENT DOCUMENTS

| | | | | |
|---|---|---|---|---|
| 5,329,501 | A * | 7/1994 | Meister | G04R 60/10 340/7.53 |
| 2004/0228219 | A1* | 11/2004 | Miyahara | G04R 20/08 368/47 |
| 2008/0117720 | A1* | 5/2008 | Ogasawara | G04R 20/10 368/47 |
| 2013/0051185 | A1 | 2/2013 | Honda et al. | |
| 2015/0253740 | A1 | 9/2015 | Nishijima et al. | |
| 2015/0277387 | A1* | 10/2015 | Hasegawa | G04R 20/10 368/239 |
| 2015/0358201 | A1* | 12/2015 | Park | H04M 19/04 715/735 |
| 2016/0252889 | A1 | 9/2016 | Honda | |
| 2016/0266553 | A1 | 9/2016 | Hasegawa | |

(Continued)

FOREIGN PATENT DOCUMENTS

| | | | |
|---|---|---|---|
| CN | 102968052 | A | 3/2013 |
| CN | 104898402 | A | 9/2015 |

(Continued)

*Primary Examiner* — Sean Kayes

(74) *Attorney, Agent, or Firm* — Harness, Dickey & Pierce, P.L.C.

(57) ABSTRACT

An electronic timepiece prevents the internal time from shifting because time information for correcting the internal time cannot be received. The electronic timepiece includes: a timekeeper; a receiver; an operating device; an automatic reception controller; a time adjuster; and a reception setter configured to selectively set a first automatic reception prohibition mode that prohibits operation of the automatic reception controller and is cancelled by a single operation of the operating device, and a second automatic reception prohibition mode that prohibits operation of the automatic reception controller and is cancelled by a specific operation of the operating device that is different from the operation that cancels the first automatic reception prohibition mode.

11 Claims, 9 Drawing Sheets

(56) References Cited

U.S. PATENT DOCUMENTS

| | | | | |
|---|---|---|---|---|
| 2017/0003654 | A1 | 1/2017 | Mitani | |
| 2017/0003659 | A1 | 1/2017 | Nakanishi | |
| 2017/0185048 | A1* | 6/2017 | Yuen | G04G 21/04 |
| 2018/0101140 | A1* | 4/2018 | Yuen | G04B 19/30 |
| 2019/0196411 | A1* | 6/2019 | Yuen | A61B 5/02416 |
| 2021/0259049 | A1* | 8/2021 | Matsuoh | H04B 1/385 |

FOREIGN PATENT DOCUMENTS

| | | | |
|---|---|---|---|
| JP | 2008-224658 | A | 9/2008 |
| JP | 2013-050347 | A | 3/2013 |
| JP | 2016-038274 | A | 3/2016 |
| JP | 2016-161283 | A | 9/2016 |
| JP | 2016-170055 | A | 9/2016 |

* cited by examiner

ELECTRONIC TIMEPIECE

BACKGROUND

This application is based upon Japanese Patent Application 2018-183866 filed on Sep. 28, 2018, the entire contents of which are incorporated by reference herein.

1. Technical Field

The present invention relates to an electronic timepiece.

2. Related Art

Electronic timepieces that receive satellite signals transmitted from GPS (Global Positioning System) satellites, acquire time information from the satellite signals, correct the internal time of the timepiece based on the acquired time information, and have an automatic reception function for automatically receiving satellite signals when an automatic reception condition is met are known from the literature. See, for example, JP-A-2016-161283.

The electronic timepiece described in JP-A-2016-161283 enables the user to disable the automatic reception function when use of a GPS receiver is prohibited, such as when flying in an airplane.

When an electronic timepiece such as described in JP-A-2016-161283 is shipped from the factory to a seller or user, the electronic timepiece may be shipped by air. As a result, so that the automatic reception process will not execute when in transit on an airplane, the electronic timepiece may be shipped with the automatic reception function turned off (disabled). In this event, the automatic reception function may still be disabled when the electronic timepiece reaches the user.

When this happens the user may start using the electronic timepiece with the automatic reception function turned off. Time information can therefore not be received, and the internal time will not be updated.

SUMMARY

An electronic timepiece according to an aspect of the invention includes a timekeeper configured to keep an internal time; a receiver configured to receive time information; an operating device including an operating button or a crown; an automatic reception controller configured to determine whether or not an automatic reception condition of the time information is met, and operate the receiver to execute a reception process if the automatic reception condition is met; a time adjuster configured to adjust the internal time based on the time information the receiver received; and a reception setter configured to selectively set a first automatic reception prohibition mode that prohibits operation of the automatic reception controller and is cancelled by a single operation of the operating device, and a second automatic reception prohibition mode that prohibits operation of the automatic reception controller and is cancelled by a specific operation of the operating device that is different from the operation that cancels the first automatic reception prohibition mode.

Preferably in an electronic timepiece according to another aspect of the invention, the operating device includes multiple operating buttons; and the first automatic reception prohibition mode is cancelled when any one of the multiple operating buttons is pushed.

Preferably in an electronic timepiece according to another aspect of the invention, the operating device includes the crown; and the first automatic reception prohibition mode is cancelled when the crown is turned or when the crown is pulled out.

Preferably in an electronic timepiece according to another aspect of the invention, the operating device includes the operating button and the crown; and the first automatic reception prohibition mode is cancelled when the operating button is pushed or when the crown is pulled out.

Preferably in an electronic timepiece according to another aspect of the invention, the operating device includes the operating button and the crown; and the specific operation includes an operation in which the crown is pulled out and an operation in which the operating button is pushed.

Preferably in an electronic timepiece according to another aspect of the invention, the reception setter sets the first automatic reception prohibition mode when a first setting operation is executed by the operating device, and sets the second automatic reception prohibition mode when a second setting operation is executed by the operating device; and the first setting operation requires more operations of the operating device than the second setting operation.

Preferably in an electronic timepiece according to another aspect of the invention, the operating device includes the operating button and the crown; and the reception setter sets the first automatic reception prohibition mode based on an operation of only the operating button.

Preferably, an electronic timepiece according to another aspect of the invention also has multiple hands that indicate time; a driver configured to drive the multiple hands; and a display controller configured to control the driver; the display controller controlling the driver to stop driving one hand of the multiple hands when the first automatic reception prohibition mode is set, and controlling the driver to drive the multiple hands to indicate the time when the second automatic reception prohibition mode is set.

An electronic timepiece according to another aspect of the invention has a timekeeper configured to keep an internal time; a receiver configured to receive time information; an operating device including an operating button or a crown; multiple hands that indicate time; a driver configured to drive the multiple hands; and a display controller configured to control the driver; an automatic reception controller configured to determine whether or not an automatic reception condition of the time information is met, and operate the receiver to execute a reception process if the automatic reception condition is met; a time adjuster configured to adjust the internal time based on the time information the receiver received; and a reception setter configured to selectively set and cancel a first automatic reception prohibition mode and a second automatic reception prohibition mode that prohibit operation of the automatic reception controller; the display controller controlling the driver to stop driving one hand of the multiple hands when the first automatic reception prohibition mode is set, and controlling the driver to drive the multiple hands to indicate the time when the second automatic reception prohibition mode is set.

Preferably in an electronic timepiece according to another aspect of the invention, the display controller controls the driver to stop one hand at a predetermined position when the first automatic reception prohibition mode is set.

Preferably in an electronic timepiece according to another aspect of the invention, the automatic reception condition includes illuminance of light incident to the electronic timepiece exceeding a specific threshold.

Preferably, an electronic timepiece according to another aspect of the invention also has a scheduled reception time storage configured to store a scheduled reception time; the automatic reception condition including the internal time matching the scheduled reception time.

Preferably, an electronic timepiece according to another aspect of the invention also has a manual reception controller configured to operate the receiver to execute a manual reception process when an operation to start manual reception is executed by the operating device; the scheduled reception time storage storing an internal time when the manual reception process was successful as the scheduled reception time when the manual reception process of the manual reception controller is successful; and the reception setter deleting the scheduled reception time stored in the scheduled reception time storage when setting the first automatic reception prohibition mode.

Other objects and attainments together with a fuller understanding of the invention will become apparent and appreciated by referring to the following description and claims taken in conjunction with the accompanying drawings.

DESCRIPTION OF EMBODIMENTS

Embodiment 1

An electronic timepiece 1 according to the first embodiment of the invention is described below with reference to the accompanying figures.

Figure 1:
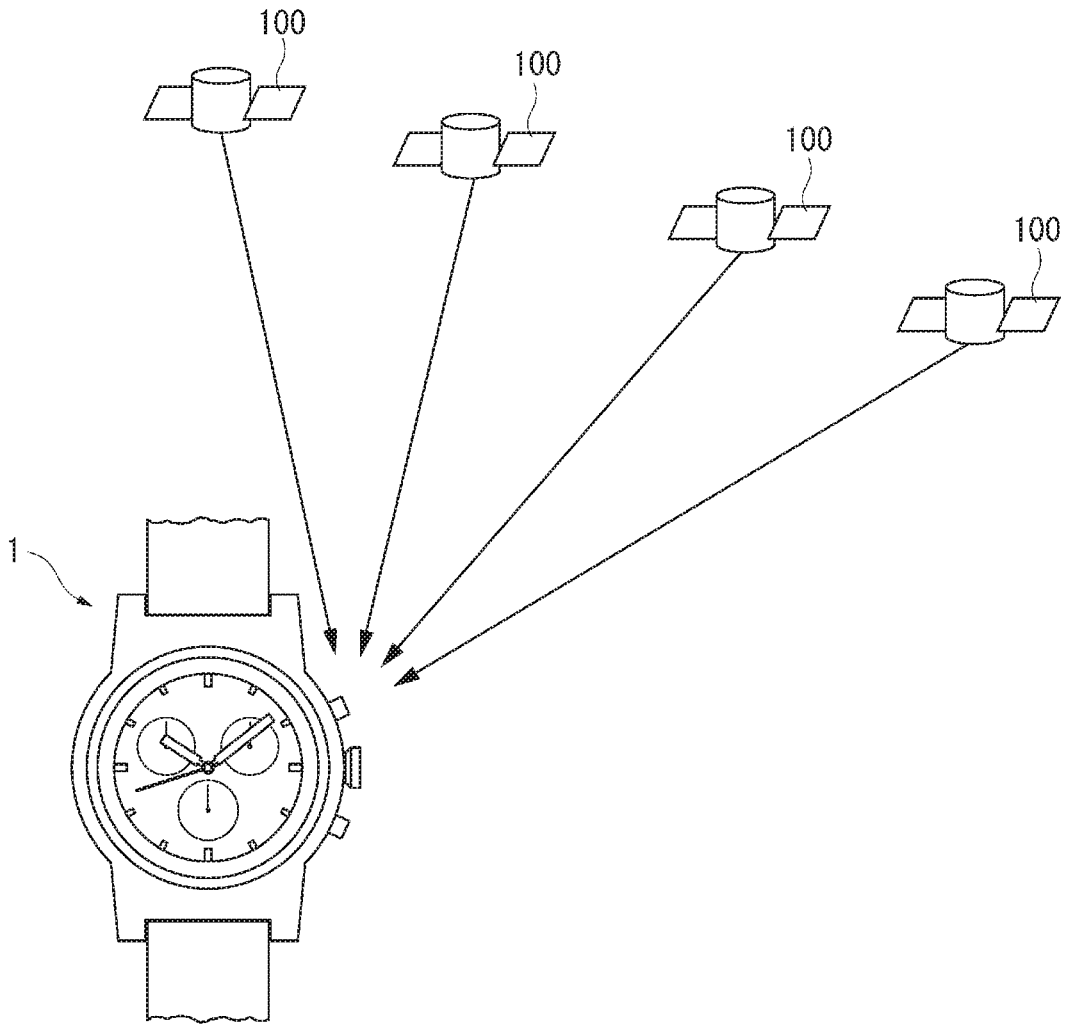
FIG. 1 schematically illustrates use of an electronic timepiece according to the first embodiment of the invention.
Figure 2:
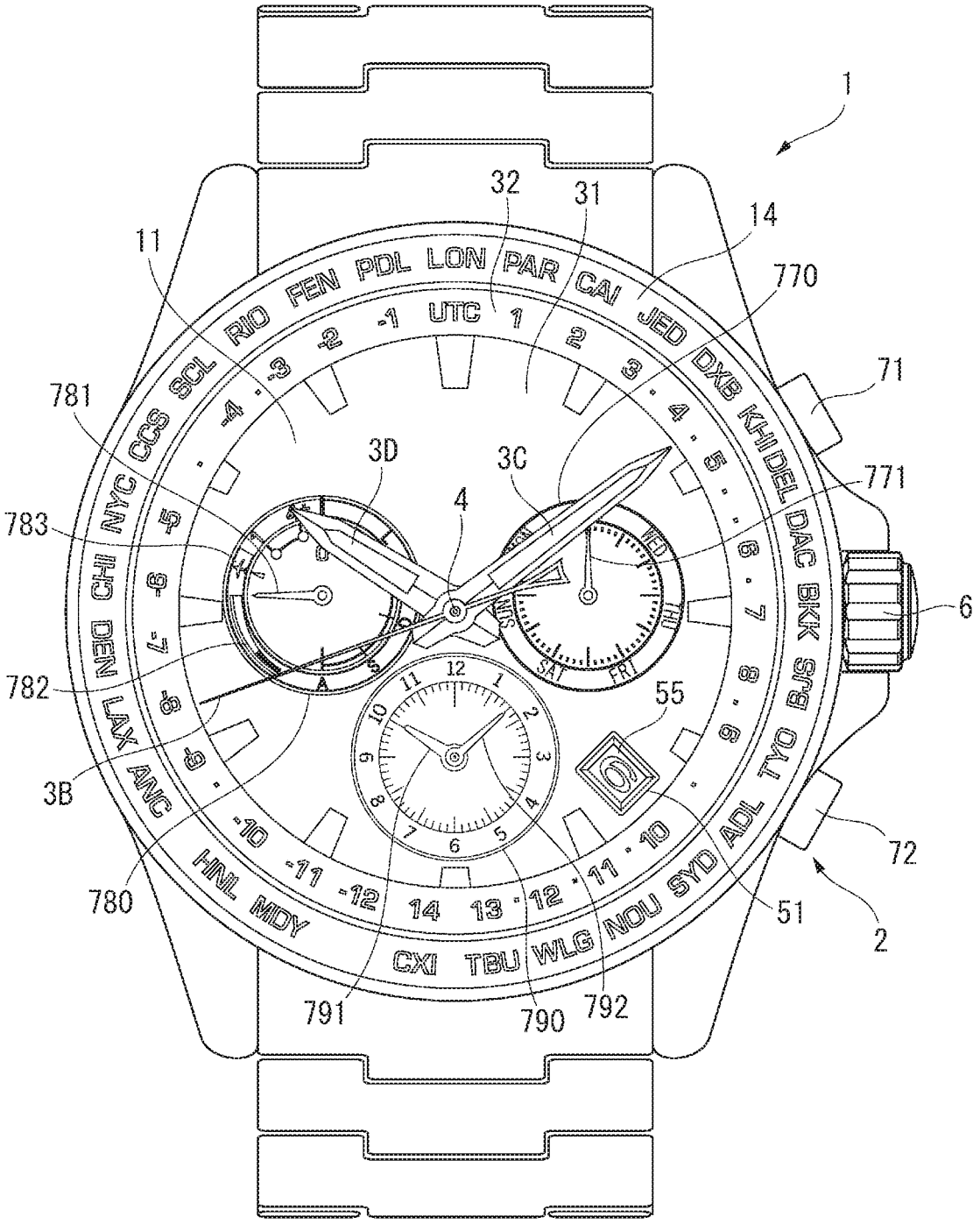
FIG. 2 is a plan view of the electronic timepiece according to the first embodiment of the invention.
Figure 3:
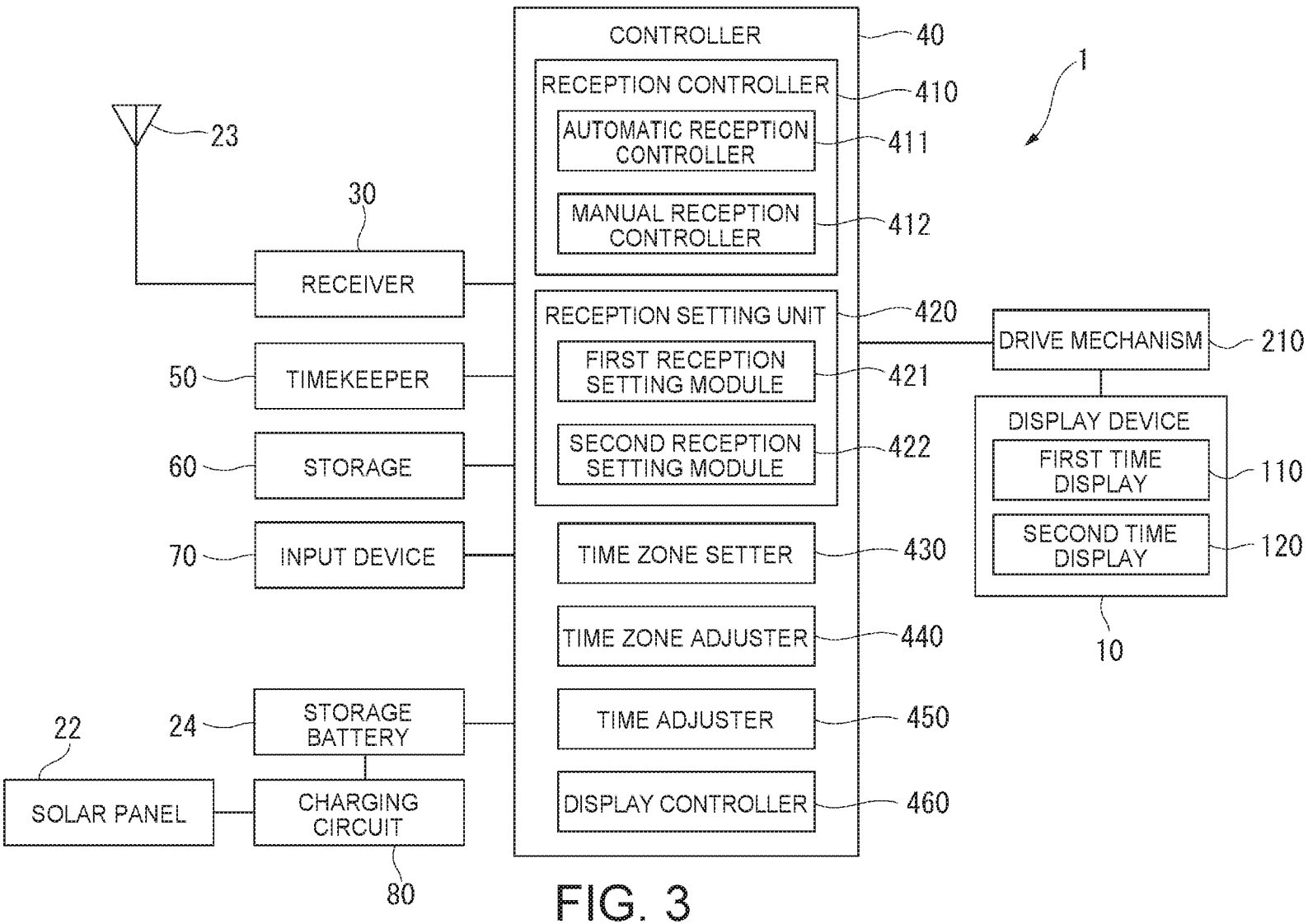
FIG. 3 is a block diagram illustrating the configuration of the electronic timepiece according to the first embodiment of the invention.

FIG. 1 schematically illustrates use of an electronic timepiece 1 according to the first embodiment of the invention, FIG. 2 is a plan view of the electronic timepiece 1, and FIG. 3 is a block diagram illustrating the configuration of the electronic timepiece 1.

As shown in FIG. 1, the electronic timepiece 1 is configured to receive satellite signals from at least one GPS satellite 100 in a constellation of multiple GPS satellites 100 orbiting the Earth on known orbits in space, and acquire time information from the satellite signals. The electronic timepiece 1 is also configured to receive satellite signals from at least three GPS satellites 100 and calculate its current location. There are presently approximately 30 GPS satellites 100 in orbit.

Electronic Timepiece

As shown in FIG. 2, the electronic timepiece 1 has a dial 11 and an external case 2. The external case 2 has a basically cylindrical shape, and is made from stainless steel (SUS), titanium, or other metal. At the opening on the face side of the external case 2, a crystal 31 covering the opening is attached by a bezel 14. The bezel 14 is made from a metal such as stainless steel, a titanium alloy, aluminum, or brass, and has city markers used to select a time zone.

The electronic timepiece 1 also has an A button 71 offset from the center of the dial 11 to a position at 2:00, a B button 72 disposed to a position at 4:00, and a crown 6 disposed to the position at 3:00. When the user operates the A button 71, B button 72, or crown 6, operating signals are output according to the operation.

The dial 11 is a round disk made of polycarbonate or other electrically non-conductive material. In the plane center of the dial 11 is disposed a center arbor 4 passing through the dial 11, and a second hand 3B, minute hand 3C, and hour hand 3D are attached to the center arbor 4.

Hands 3B to 3D are examples of hands for displaying time in the invention. The dial 11 and hands 3B to 3D together configure a first time display 110. A dial ring 32 is attached around the outside of the dial 11.

The dial 11 also has three windows. As shown in FIG. 2, relative to the center of the dial 11, a round first subdial 770 and a small hand 771 are disposed at 3:00, a round second subdial 780 and small hand 781 are disposed at 9:00, and a round third subdial 790 and small hands 791 and 792 are disposed at 6:00.

A rectangular date window 51 is disposed relative to the center of the dial 11 in the direction between 4:00 and 5:00. A date indicator 55 is disposed on the back cover side of the dial 11, and the date indicator 55 can be seen through the date window 51.

In this embodiment, the small hand 771 of the first subdial 770 is a day hand indicating the day of the week, and the small hand 781 of the second subdial 780 is a mode indicator for indicating other information. The hands 791, 792 of the third subdial 790 are the hour hand and minute hand of a small clock for indicating the home time or local time, for example.

The second subdial 780 has markers pointed to by small hand 781, which is a mode indicator in this example, the markers including a power indicator 782, a daylight saving time mode setting, an airplane marker 783, and a GPS satellite signal reception mode setting.

The power indicator indicates the power reserve of the storage battery 24 described below in a band extending from 9:00 to 7:00 on the second subdial 780, the 9:00 position indicating a full charge (F), and the 7:00 position indicating an empty charge (E).

The markers for indicating the daylight saving time mode setting include an A at 6:00, an S at approximately 5:00, and a D at approximately 4:00.

The 'A' means an AUTO mode for automatically setting daylight saving time. The AUTO mode is a mode for automatically changing the daylight saving time setting when positioning information is acquired from satellite signals.

The 'S' indicates a STD mode (standard mode) for always displaying the standard time in response to a manual setting.

The 'D' means the daylight saving time (DST) mode, and indicates a mode for always displaying daylight saving time in response to a manual setting.

The airplane marker 783 indicates the airplane mode and is displayed at 10:00 on the second subdial 780. A '1' marker indicating the timekeeping mode of the reception mode is shown at approximately 11:00, and a '4+' marker indicating the navigation mode of the reception mode is shown at approximately 12:00. An 'L' marker indicating a reception mode for acquiring leap second information is shown at approximately 1:00.

A scale dividing the inside circumference into 60 divisions is formed on the inside circumference side of the third subdial 790. Using this scale, the small hand 791 normally indicates the hour of the home time, and the small hand 792 indicates the minute of the home time. The third subdial 790 and hands 791, 792 together configure a second time display 120.

Configuration of the Electronic Timepiece

As shown in FIG. 3, the electronic timepiece 1 has a display device 10, a solar panel 22, antenna 23, storage battery 24, receiver 30, controller 40, timekeeper 50, storage 60, input device 70, charging circuit 80, and drive mechanism 210. These devices send and receive data through a data bus.

The input device 70 is configured by the crown 6, A button 71, and B button 72 shown in FIG. 2. More specifically, the input device 70 is an example of an operating device (operator) in the accompanying claims, and the A button 71 and B button 72 are examples of operating buttons in the accompanying claims. In this example the input device 70, which is an operating device, is configured by multiple operating buttons.

The charging circuit 80 supplies power generated by the solar panel 22 to the storage battery 24 to charge the storage battery 24.

The drive mechanism 210 is configured by stepper motors not shown that drive the hands 3B-3D, 771, 781, 791, 792 and date indicator 55, wheel trains, and control circuits.

Note that the drive mechanism 210 is an example of a drive means (driver) of the invention.

The display device 10 includes the first time display 110 and the second time display 120.

Receiver

When the receiver 30 is driven by the controller 40, the receiver 30 receives time information transmitted from GPS satellites 100 through the antenna 23. In other words, the receiver 30 is an example of a receiving means (receiver) in the accompanying claims.

When the receiver 30 successfully receives time information, it sends the time information to the controller 40.

If the receiver 30 fails to receive time information, the receiver 30 reports a reception failure to the controller 40.

Note that the configuration of the receiver 30 is the same as the configuration of a GPS reception circuit known from the literature, and further description thereof is omitted.

Timekeeping Device

The timekeeper 50 includes a crystal oscillator that is driven by power stored in the storage battery 24, and keeps the internal time using a reference signal based on the oscillation signal from the crystal oscillator.

Note that the timekeeper 50 is an example of a timekeeper in the accompanying claims.

Storage

Figure 4:
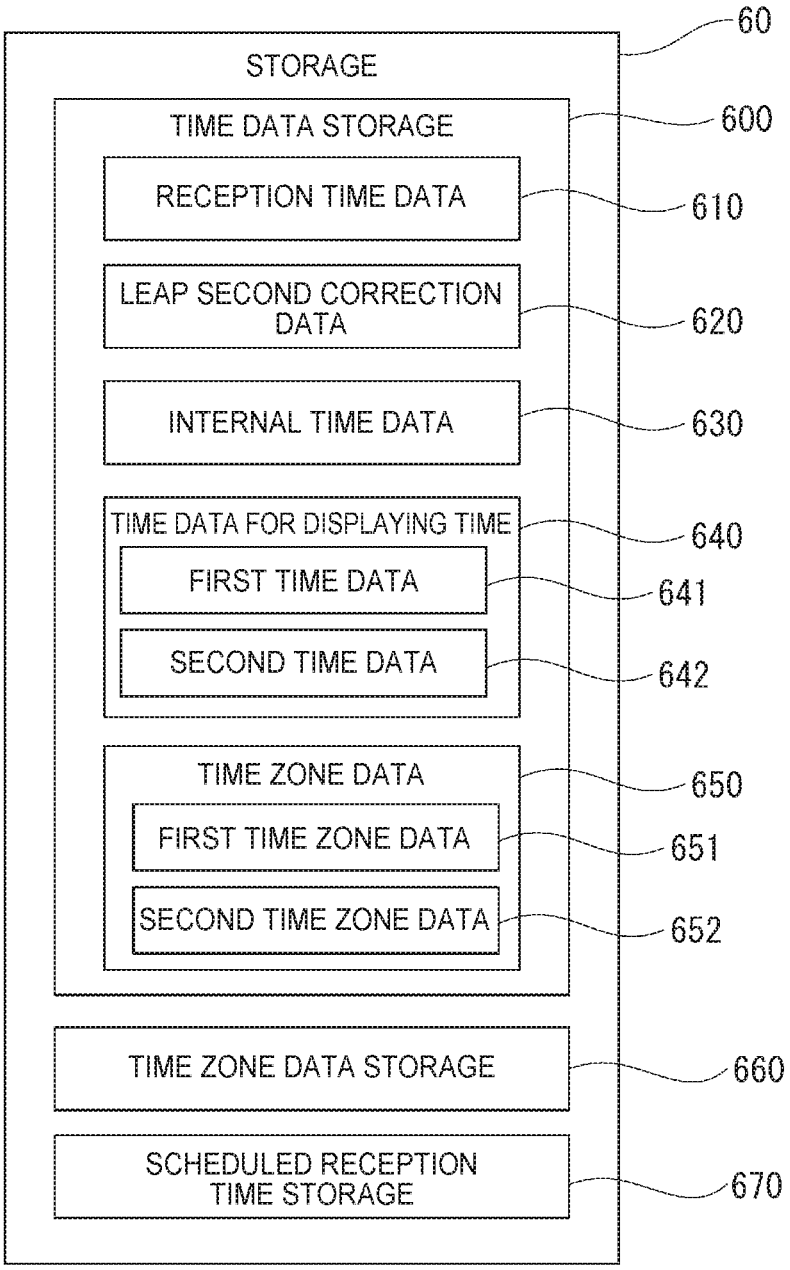
FIG. 4 is a block diagram illustrating the data structure of a storage device in the first embodiment.

FIG. 4 is a block diagram showing the configuration of the storage 60.

The storage 60 is configured with RAM (Random Access Memory) and ROM (Read Only Memory), and as shown in FIG. 4 includes a time data storage 600, time zone data storage 660, and scheduled reception time storage 670.

Reception time data 610, leap second correction data 620, internal time data 630, time data for displaying time 640, and time zone data 650 are stored in the time data storage 600.

Time information received by the receiver 30 is stored in the reception time data 610. The reception time data 610 is normally updated at a one-second interval by the timekeeper 50, and when time information is received, the received time information is stored.

Data about at least the current leap second is stored in the leap second correction data 620. More specifically, the current leap second value, the week number of the leap second event, the day number of the leap second event, and the future leap second value are contained on page 8 of subframe 4 in the satellite signals as data related to the leap second. Of this information, at least the current leap second value is stored in the leap second correction data 620.

The internal time is stored in the internal time data 630. This internal time is updated based on time information stored in the reception time data 610, and the current leap second value stored in the leap second correction data 620. More specifically, UTC (Coordinated Universal Time) is stored in the internal time data 630. When the reception time data 610 is updated by the timekeeper 50, this internal time is also updated.

Time data adding the time zone data in the time zone data 650 to the internal time of the internal time data 630 described above is stored as the time data for displaying time 640.

In this embodiment, the time data for displaying time 640 includes first time data 641 and second time data 642, and the time zone data 650 includes first time zone data 651 and second time zone data 652.

The first time data 641 stores time data acquired by adding the time zone data of the first time zone data 651 to the internal time of the internal time data 630. The first time zone data 651 is set by the time zone data acquired when the time zone is selected by the user, and when time zone information is received in the navigation mode.

The second time data 642 stores time data acquired by adding the time zone data of the second time zone data 652 to the internal time of the internal time data 630. The second time zone data 652 is set by the time zone data selected manually by the user.

The time zone data storage 660 relationally stores location information comprising latitude and longitude values to time zone information, which is time difference information. As a result, the controller 40 is configured to acquire time zone data based on the location information when location (positioning) information is acquired in the navigation mode.

The time zone data storage 660 also stores city names relationally to the time zone data. Therefore, when the user selects the city name for which the current time is desired by operating the crown 6 or other input device 70, the controller 40 can search the time zone data storage 660 for the city name set by the user. The controller 40 can then acquire the time zone data associated with that city name, and set the first time zone data 651 or second time zone data 652.

The scheduled reception time at which the scheduled reception process is executed is stored in the scheduled reception time storage 670. The scheduled reception time in this example is the internal time when reception was successful in response to the user manually starting reception.

Controller

Referring again to FIG. 3, the controller 40 is configured with a CPU (central processing unit) that controls the electronic timepiece 1. The controller 40 includes a reception controller 410, reception setting unit 420, time zone setter 430, time zone adjuster 440, time adjuster 450, and display controller 460.

Reception Controller

The reception controller 410 includes an automatic reception controller 411, and a manual reception controller 412.

When operation is not prohibited by the first reception setting module 421 or the second reception setting module 422, that is, when the automatic reception function is not set to disabled, the automatic reception controller 411 determines whether or not an automatic reception condition for satellite signals is met. If the automatic reception condition is met, the automatic reception controller 411 operates the receiver 30 to execute the automatic reception process in the timekeeping mode.

There are two types of automatic reception processes, a scheduled automatic reception process and a light-based automatic reception process.

The scheduled automatic reception process is executed when the internal time stored in the internal time data 630 matches the scheduled reception time stored in the scheduled reception time storage 670.

The light-based automatic reception process is executed when the output voltage or the output current of the solar panel 22 exceeds a set threshold, and it can be determined that the electronic timepiece is outdoors and the solar panel 22 is exposed to sunlight. Note that the light-based automatic reception process is not limited to executing when the output voltage or the output current of the solar panel 22 exceeds a set threshold. For example, an optical sensor such as a photodiode or phototransistor may be provided, and the light-based automatic reception process executed when the detection value of the optical sensor exceeds a set threshold. More specifically, the light-based automatic reception process is executed when the illuminance of light incident to the electronic timepiece 1 exceeds a specific threshold.

Note that the number of times the automatic reception process executes may be restricted so that, for example, only one of the scheduled automatic reception process and light-based automatic reception process executes once a day. Alternatively, operation may be restricted so that the scheduled automatic reception process and light-based automatic reception process each execute once a day.

When the automatic reception process executes, the receiver 30 locks onto at least one GPS satellite 100, and receives satellite signals and acquires time information transmitted from that GPS satellite 100.

Based on the input operation on the input device 70, the manual reception controller 412 operates the receiver 30 and executes the manual reception process in the timekeeping mode or the navigation mode.

More specifically, when the A button 71 is pushed for 3 seconds or longer as the operation to start manual reception, the manual reception controller 412 operates the receiver 30 and executes the manual reception process in the timekeeping mode. When the manual reception process executes in the timekeeping mode, the receiver 30 locks onto at least one GPS satellite 100, receives satellite signals transmitted from the GPS satellite 100, and acquires time information.

When the B button 72 is pushed for 3 seconds or longer as the operation to start manual reception, the manual reception controller 412 operates the receiver 30 and executes the manual reception process in the navigation mode. When the manual reception process executes in the navigation mode, the receiver 30 locks onto at least three GPS satellites 100, and preferably four or more GPS satellites 100, receives satellite signals transmitted from each GPS satellite 100, and calculates and acquires positioning information. The receiver 30 can also simultaneously acquire time information when satellite signals are received in the navigation mode.

This embodiment of the invention can thus operate in a time keeping mode and a navigation mode, and can acquire time information in both modes.

Reception Setting Unit

The reception setting unit 420 includes a first reception setting module 421 and a second reception setting module 422.

The first reception setting module 421 sets the shipping mode that prohibits operation of the automatic reception controller 411, that is, disables the automatic reception function, and cancels the shipping mode.

More specifically, the first reception setting module 421 sets the shipping mode when a first setting operation is executed on the input device 70.

An example of this first setting operation is when an operation of pushing the A button 71 of the input device 70 twice for less than three seconds, and then an operation of pushing the A button 71 for six seconds or more, are executed. In this embodiment of the invention the first reception setting module 421 sets the shipping mode when the A button 71 of the input device 70 is operated three times in this way.

When the shipping mode is set and a first cancel operation is executed by the input device 70, the first reception setting module 421 cancels the shipping mode. An example of the first cancel operation is operating the crown 6, A button 71, or B button 72 once.

Note that the shipping mode is an example of a first automatic reception prohibition mode in the accompanying claims.

The shipping mode is a mode that is primarily set when the electronic timepiece 1 is shipped from the factory. Because the electronic timepiece 1 may be transported by airplane when shipped from the factory, the shipping mode is set to disable the automatic reception function. As a result, the shipping mode is primarily set by a worker in the factory, for example.

Note that the shipping mode is not limited to when a new electronic timepiece 1 is shipped from the factory, and may also be set when the electronic timepiece 1 is shipped after being repaired at the factory, for example.

The second reception setting module 422 sets the airplane mode that prohibits operation of the automatic reception controller 411, that is, disables the automatic reception function, and cancels the airplane mode.

More specifically, the second reception setting module 422 sets the airplane mode when a second setting operation is executed on the input device 70.

An example of the second setting operation is an operation of pulling the crown 6 of the input device 70 out to the first stop, and then pushing the B button 72 for three seconds or more and less than six seconds. In this embodiment of the invention the second reception setting module 422 sets the airplane mode when the crown 6 and B button 72 are pushed once each, that is, when the input device 70 is operated twice as described above.

When the airplane mode is set and a second cancel operation is executed by the input device 70, the second reception setting module 422 cancels the airplane mode. An example of the second cancel operation is pulling the crown 6 out to the first stop, and then pushing the B button 72 for three seconds or more and less than six seconds. In other words, the second reception setting module 422 cancels the airplane mode when an operation different from the first cancel operation is executed using the input device 70.

Note that the airplane mode is an example of a second automatic reception prohibition mode in the accompanying claims, and the second cancel operation for cancelling the airplane mode is an example of a specific operation in the accompanying claims.

Note that when the airplane mode is set by the second reception setting module 422, the small hand 781 points to the airplane marker 783 indicating the airplane mode as described above.

In this embodiment as described above the second setting operation that sets the airplane mode, and the second cancel operation that cancels the airplane mode, are the same operation. As a result, because the user can set and cancel the airplane mode using the same operation, the operation for setting and cancelling the airplane mode can be easily remembered.

The second setting operation and second cancel operation are not limited to the same operations, and may be different operations. For example, if the second setting operation is an operation of pulling the crown 6 out to the first stop and then pushing the B button 72 for three seconds or more and less than six seconds, the second cancel operation may be an operation of pulling the crown 6 out to the first stop and then pushing the A button 71 for three seconds or more and less than six seconds.

In this case, the user can be prevented from accidentally cancelling the airplane mode when the user is aboard an airplane. More specifically, even if the user executes the operation for setting the airplane mode without realizing that the airplane mode is already set, the airplane mode will not be cancelled because the operation for setting the airplane mode and the operation for cancelling the airplane mode are different.

As described above, the first setting operation for setting the shipping mode in this embodiment of the invention involves the input device 70 being operated three times, but in the second setting operation for setting the airplane mode, the input device 70 is operated only two times. As a result, the number of times the input device 70 is operated is greater in the first setting operation than in the second setting operation.

When counting the number of times the input device 70 is operated, the input device 70 is counted to have been operated once when an operation of pushing the A button 71 or B button 72 is executed one time, or when the operation of pulling out the crown 6 is executed one time.

The operation of pulling the crown 6 out to the second stop may be counted as the input device 70 being operated one time or operated two times.

In addition, in a configuration that can detect rotation of the crown 6, the input device 70 may be counted to have been operated one time each time rotation of the crown 6 is detected. Note that detecting rotation of the crown 6 may be configured to detect a rotation each time the crown 6 is turned 120°, for example.

Also in this embodiment of the invention the first reception setting module 421 sets the shipping mode based on operation of only the A button 71, and the second reception setting module 422 sets the airplane mode based on operation of both the crown 6 and B button 72.

Note also that in this embodiment the shipping mode and airplane mode are set selectively (exclusively), and both modes cannot be set (enabled) at the same time. More specifically, because the input device 70 is necessarily operated to set the airplane mode when the shipping mode is already set, the first cancel operation will be executed and the shipping mode will be cancelled. As a result, the airplane mode cannot be set when the shipping mode is already set.

Similarly, even if the first setting operation is executed to set the shipping mode when the airplane mode is already set, the reception setting unit 420 is configured so that shipping mode will not be set. More specifically, the reception setting unit 420 is configured to not set the shipping mode when the airplane mode has been cancelled unless the first setting operation is executed.

The invention is not so limited, however, and the reception setting unit 420 may be configured to cancel the airplane mode and set the shipping mode if the first setting operation is executed when the airplane mode is set.

Time Zone Setter

When the manual reception controller 412 successfully acquires location information, the time zone setter 430 sets the time zone data based on the acquired location information. More specifically, the time zone setter 430 selects and acquires time zone data corresponding to the location information from the time zone data storage 660, and stores the time zone data in the first time zone data 651.

For example, Japan Standard Time (JST) is nine hours ahead of UTC (UTC+9). Therefore, when the location information the manual reception controller 412 acquired identifies a location in Japan, the time zone setter 430 reads the time difference to Japan Standard Time from the time zone data storage 660, and stores the time difference in the first time zone data 651.

When time difference information or city name information is selected by the user, the time zone setter 430 stores the time zone data corresponding to the selected time difference information or city name information in the first time zone data 651 or second time zone data 652.

Time Zone Adjuster

When the time zone setter 430 sets the time zone information, the time zone adjuster 440 corrects the time data for displaying time 640 using the time zone data. More specifically, the time zone adjuster 440 corrects the first time data 641 using the first time zone data 651, and corrects the second time data 642 using the second time zone data 652. As a result, the first time data 641 and second time data 642 are adjusted to times adding the time zone data to the internal time data 630, which is UTC.

When the user selects a desired time zone, the time zone adjuster 440 adjusts the time data for displaying time 640 using the time zone data for the selected time zone.

Time Adjuster

When acquiring time information in the reception process of the automatic reception controller 411 or the manual reception controller 412 is successful, the time adjuster 450 adjusts the reception time data 610 based on the acquired time information. As a result, the internal time data 630, first time data 641, and second time data 642 are adjusted. More specifically, the time adjuster 450 adjusts the internal time based on the time information the receiver 30 received.

Display Controller

The display controller 460 controls the drive mechanism 210 to display the time information for the first time data 641 by the hands 3B to 3D, and display the time information of the second time data 642 by the hands 791, 792.

When the shipping mode is set by the first reception setting module 421, the display controller 460 controls the drive mechanism 210 to stop the hands 3B to 3D and hands 791, 792 at predetermined positions. More specifically, the display controller 460 moves the hands 3B to 3D and hands 791, 792 to the predetermined positions, and then stops driving the hands 3B to 3D and hands 791, 792 at those positions. In the example shown in FIG. 2, the display controller 460 stops the hands 3B to 3D at positions pointing to 10:08:42, and stops the hands 791, 792 at positions pointing to 10:08.

Note that the display controller 460 is not limited to stopping all of hands 3B to 3D and 791, 792 when the shipping mode is set, and may be configured to stop driving at least one of the multiple hands 3B to 3D and 791, 792.

The positions at which driving hands 3B to 3D and hands 791, 792 stops is obviously also not limited to the positions described above, and the hands may be stopped at the current time when the shipping mode was set. In other words, the display controller 460 may stop driving hands 3B to 3D and hands 791, 792 at the time when the shipping mode is set.

When the shipping mode is set the display controller 460 may also control the drive mechanism 210 to stop the small hands 771 and 781 and the date indicator 55. For example, the display controller 460 may stop the small hand 771 and date indicator 55 at the positions when the shipping mode was set. The display controller 460 may also move the small hand 781 to the position pointing to the airplane marker 783, and stop the small hand 781 at that position.

Method of Controlling Setting and Cancelling the Shipping Mode

The method of controlling setting and cancelling the shipping mode is described next based on the flow chart in FIG. 5.

Figure 5:
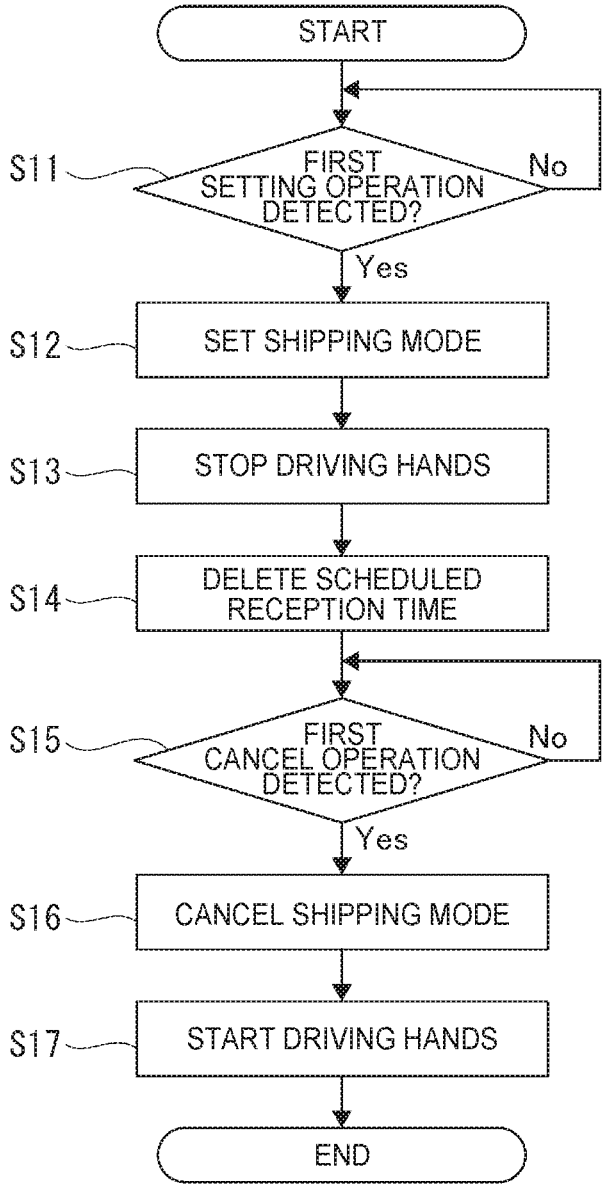
FIG. 5 is a flow chart of the control method for setting and cancelling the shipping mode in the first embodiment of the invention.

As shown in FIG. 5, the first reception setting module 421 of the reception setting unit 420 determines in step S11 whether or not the first setting operation was executed using the input device 70. More specifically, the first reception setting module 421 determines if the operation of pushing the A button 71 of the input device 70 for less than three second was executed two times, and the A button 71 was then pushed for six seconds or more.

When step S11 returns No, the first reception setting module 421 repeats the evaluation process of step S11 until the first setting operation is executed on the input device 70.

When step S11 returns Yes, in step S12 the first reception setting module 421 sets the shipping mode that prohibits operation of the automatic reception controller 411.

When the shipping mode is set by the first reception setting module 421 in step S12, the display controller 460 controls the drive mechanism 210 in step S13 to move the hands 3B to 3D to the positions indicating 10:08:42, and then stop the hands 3B to 3D at those positions. The display controller 460 also controls the drive mechanism 210 to move the hands 791, 792 to the positions indicating 10:08, and then stops the hands 791, 792 at those positions. More specifically, that the shipping mode is set is displayed in this embodiment by stopping driving the hands 3B to 3D and hands 791, 792 that indicate the time. However, the timekeeper 50 continues keeping the internal time.

The first reception setting module 421, in step S14, then deletes the scheduled reception time stored in the scheduled reception time storage 670.

Next, in step S15, the first reception setting module 421, determines whether or not the first cancel operation was executed on the input device 70. More specifically, the first reception setting module 421 determines whether or not the crown 6, A button 71, or B button 72 of the input device 70 was operated. More specifically, the first reception setting module 421 determines whether or not the crown 6 was pulled out, or if A button 71 or B button 72 was pushed. Note that if rotation of the crown 6 at the 0 stop position can be detected, the first reception setting module 421 may also determine whether or not the crown 6 was turned.

When step S15 returns No, the first reception setting module 421 repeats the evaluation process of step S15 until the first cancel operation is executed on the input device 70.

When step S15 returns Yes, the first reception setting module 421 cancels the shipping mode in step S16.

When in step S16 the shipping mode is cancelled by the first reception setting module 421, the display controller 460 controls the drive mechanism 210 in step S17 to start driving hands 3B to 3D and hands 791, 792. More specifically, the display controller 460 starts normal operation of the movement to display the time information in the first time data 641 by hands 3B to 3D, and display the time information in the second time data 642 by hands 791, 792.

The first reception setting module 421 then ends the shipping mode setting and cancelling process.

Method of Controlling Setting and Cancelling the Airplane Mode

The method of controlling setting and cancelling the airplane mode is described next with reference to the flow chart in FIG. 6.

Figure 6:
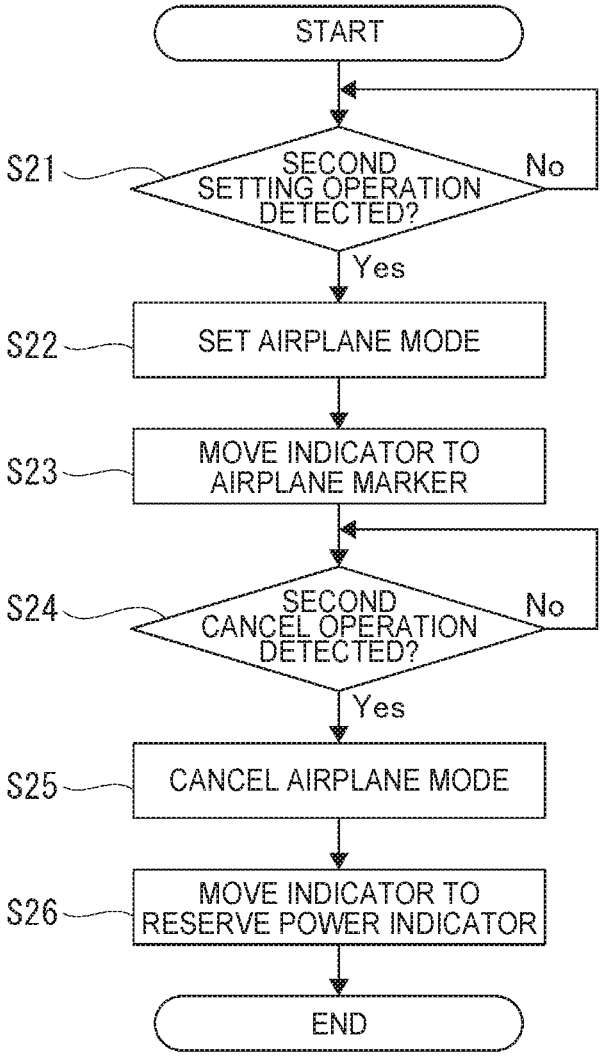
FIG. 6 is a flow chart of the control method for setting and cancelling the airplane mode in the first embodiment of the invention.

As shown in FIG. 6, the second reception setting module 422 of the reception setting unit 420 determines in step S21 whether or not the second setting operation was executed using the input device 70. More specifically, the second reception setting module 422 determines if the crown 6 of the input device 70 was pulled out to the first stop and the B button 72 was then pushed for three seconds or more and less than six seconds.

When step S21 returns No, the second reception setting module 422 repeats the evaluation process of step S21 until the second setting operation is executed on the input device 70.

When step S21 returns Yes, the second reception setting module 422 sets the airplane mode to prohibit operation of the automatic reception controller 411 in step S22.

When the airplane mode is set by the second reception setting module 422 in step S22, the display controller 460 controls the drive mechanism 210 in step S23 to move the small hand 781 to the airplane marker 783 indicating the airplane mode.

Note that when the airplane mode is set, the display controller 460 controls the drive mechanism 210 in step S23 to continue displaying the time by hands 3B to 3D and hands 791, 792. More specifically, the hands 3B to 3D and hands 791, 792 continue moving normally during the airplane mode setting and cancelling process.

Next, the second reception setting module 422 determines in step S24 whether or not the second cancel operation was executed on the input device 70. More specifically, the second reception setting module 422 determines if the crown 6 of the input device 70 was pulled out to the first stop, and the B button 72 was then pushed for three seconds or more.

When step S24 returns No, the second reception setting module 422 repeats the evaluation process of step S24 until the second cancel operation is executed on the input device 70.

When step S24 returns Yes, the second reception setting module 422 cancels the airplane mode in step S25.

When the airplane mode is cancelled by the second reception setting module 422 in step S25, the display controller 460, in step S26, controls the drive mechanism 210 to move the small hand 781 to the power indicator 782 indicating the reserve power of the battery.

The second reception setting module 422 then cancels the airplane mode setting and cancelling process.

Reception Control Method

Next, the reception control method of the electronic timepiece 1 is described with reference to the flow chart in FIG. 7.

Figure 7:
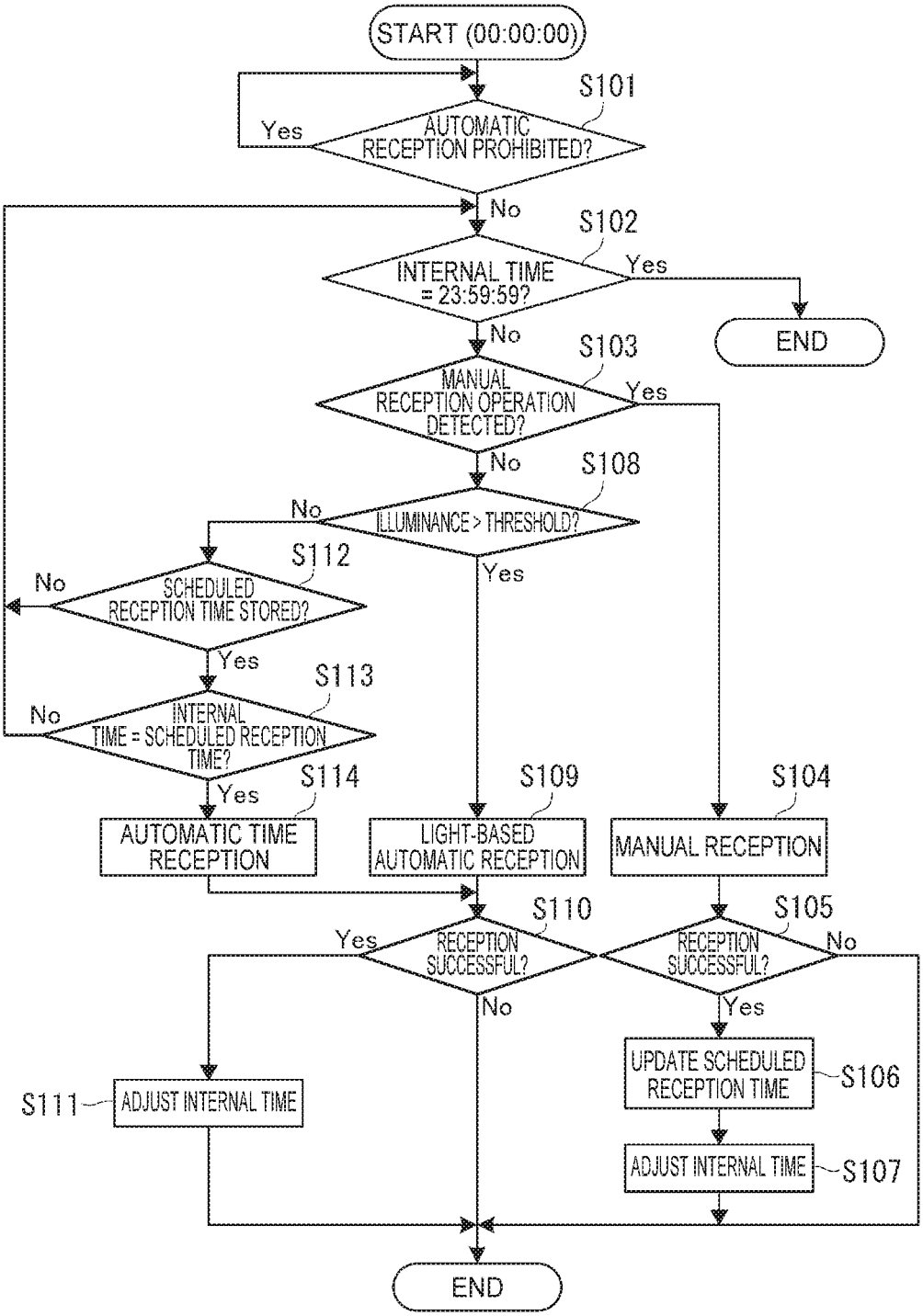
FIG. 7 is a flow chart of the reception control method in the first embodiment of the invention.

As shown in FIG. 7 the reception controller 410 starts the reception control process when the internal time kept by the timekeeper 50 goes to 00:00:00.

In step S101, the reception controller 410 determines whether or not operation is prohibited by the reception setting unit 420. More specifically, the reception controller 410 determines if either the shipping mode or airplane mode is set and automatic reception is therefore prohibited.

When step S101 returns Yes, the process of step S101 repeats until the shipping mode or airplane mode is cancelled.

However, when step S101 returns No, whether or not the internal time has reached 23:59:59 is determined in step S102.

When step S102 returns Yes, the reception control process ends. However, because the reception control process starts every day at 00:00:00, when S102 returns Yes, the reception control process starts again from step S101 one second later.

When step S102 returns No and one day has not past since the reception control process started, the reception controller 410 determines in step S103 whether or not the input device 70 was operated to start reception manually.

Manual Reception Process

If step S103 returns Yes, the manual reception controller 412 of the reception controller 410 operates the receiver 30 in step S104 to execute the manual reception process.

The manual reception controller 412 then determines in step S105 whether or not reception was successful in the manual reception process.

When step S105 returns Yes, that is, when reception is successful, the manual reception controller 412, in step S106, updates the scheduled reception time stored in the scheduled reception time storage 670 to the internal time at which manual reception was successful.

The time adjuster 450 then adjusts the reception time data 610 based on the acquired time information in step S107. As a result, the internal time data 630, first time data 641, and second time data 642 are adjusted. The reception controller 410 then ends the reception control process.

However, when step S105 returns No, the reception controller 410 immediately ends the reception control process.

Light-Based Automatic Reception Process

Returning to step S103, when No is returned by the evaluation process, the automatic reception controller 411 of the reception controller 410 determines in step S108 whether or not the output voltage or output current of the solar panel 22 exceeds the set threshold, that is, whether or not the illuminance of light incident to the electronic timepiece 1 exceeds a specific threshold.

When step S108 returns Yes, the automatic reception controller 411 operates the receiver 30 in step S109 to execute the light-based automatic reception process in the timekeeping mode.

Next, the automatic reception controller 411 determines in step S110 whether or not reception was successful in the light-based automatic reception process.

When step S110 returns Yes, that is, when reception is successful, the time adjuster 450, in step S111, adjusts the reception time data 610 based on the acquired time information. As a result, the internal time data 630, first time data 641, and second time data 642 are adjusted. The reception controller 410 then ends the reception control process.

However, when step S110 returns No, the reception controller 410 immediately ends the reception control process.

The light-based automatic reception process therefore executes only once a day.

Automatic Time Reception Process

Returning to step S108, when the evaluation process returns No, the reception controller 410 determines in step S112 whether or not the scheduled reception time is stored in the scheduled reception time storage 670.

Until the reception success time is recorded by the manual reception process after a system reset and after the shipping mode is set and cancelled, the scheduled reception time is not recorded in the scheduled reception time storage 670. As a result, step S112 will return No. In this case, control returns to step S102. More specifically, the process of steps S102, S103, S108, and S112 repeats.

However, when step S112 returns Yes, that is, when the scheduled reception time is stored in the scheduled reception time storage 670, the automatic reception controller 411 determines in step S113 whether or not the internal time kept by the timekeeper 50 is the scheduled reception time.

When step S113 returns No, control returns to step S102. More specifically, the process of steps S102, S103, S108, S112, and S113 repeats.

However, when step S113 returns Yes, that is, when the internal time matches the scheduled reception time, the automatic reception controller 411 operates the receiver 30 and executes the automatic time reception process in the timekeeping mode in step S114. As in the light-based automatic reception process, the automatic reception controller 411 then executes steps S110 and S111, and ends the reception control process.

As a result, the automatic time reception process also executes only once a day.

As described above, when the scheduled reception time is not set, such as after a system reset and after the shipping mode is set and cancelled, the reception controller 410 continues the reception control process until the manual reception process or light-based automatic reception process executes during one day.

When the scheduled reception time is set, and the scheduled reception time arrives, the reception controller 410 executes the automatic time reception process. When any of the reception processes executes, the reception control process stops until the next day.

When the manual reception process is successful, the scheduled reception time is updated to the internal time when reception was successful. Note that the time when the manual reception process is successful is normally the internal time when the manual reception process started, but may be the internal time when the manual reception process ended, or an internal time while the manual reception process is executing.

Effect of Embodiment 1

The effect of the first embodiment is described next.

This embodiment of the invention has a reception setting unit 420 for selectively setting and cancelling a shipping mode and an airplane mode that prohibit operation of the automatic reception controller 411.

When the shipping mode is set and the crown 6, A button 71, or B button 72 is operated once, the reception setting unit 420 cancels the shipping mode. More specifically, a specific operation is not required to cancel the shipping mode. Because the shipping mode is therefore cancelled as a result of the crown 6, A button 71, or B button 72 being operated without the user needing to intentionally cancel the shipping mode, using the electronic timepiece 1 with the automatic reception function disabled can be prevented. Therefore, the electronic timepiece 1 being unable to receive time information to adjust the internal time, and the internal time being incorrect, can be prevented.

When the airplane mode is set, the crown 6 of the input device 70 is pulled out to the first stop, and the B button 72 is then pushed for three seconds or more and less than six seconds, the airplane mode is cancelled. As a result, the reception setting unit 420 will not cancel the airplane mode unless a specific operation is performed. Therefore, the airplane mode being accidentally cancelled can be prevented when the user sets the airplane mode when boarding an airplane.

The specific operation is a previously defined operation of the input device 70. The specific operation also preferably involves multiple operations of the input device 70, and may be any combination of operations of the A button 71, B button 72 and crown 6.

When the shipping mode is set in this embodiment, the display controller 460 controls the drive mechanism 210 to move the hands 3B to 3D and hands 791, 792 that indicate time to previously set positions, and then stops the hands 3B to 3D and hands 791, 792 at those positions. Because the user can therefore easily recognize that driving the hands 3B to 3D and hands 791, 792 has stopped, the user can also easily know that the shipping mode is set. Using the electronic timepiece 1 with the automatic reception function disabled can therefore be prevented.

Furthermore, because the display controller 460 continues normal movement of the hands 3B to 3D and hands 791, 792 that display time when the airplane mode is set, the user can still read the time when on board an airplane with the airplane mode set.

In this embodiment, the first setting operation for setting the shipping mode requires more operations of the input device 70 than the second setting operation for setting the airplane mode. In other words, because the shipping mode is more difficult to set than the airplane mode, the user can be prevented from accidentally setting the shipping mode.

In this embodiment, the first reception setting module 421 sets the shipping mode based on operating only the A button 71. As a result, to set the shipping mode in the factory prior to shipping, for example, the worker only needs to operate the A button 71. The task of setting the shipping mode is therefore simpler than in a configuration that sets the shipping mode by a combination of B button 72 and crown 6 operations, and productivity can be improved.

Embodiment 2

A second embodiment of the invention is described next with reference to accompanying figures.

Note that the construction of the electronic timepiece 1 according to this embodiment is the same as the first embodiment described above, and further detailed description thereof is therefore omitted.

Method of Controlling Setting and Cancelling the Shipping Mode

Figure 8:
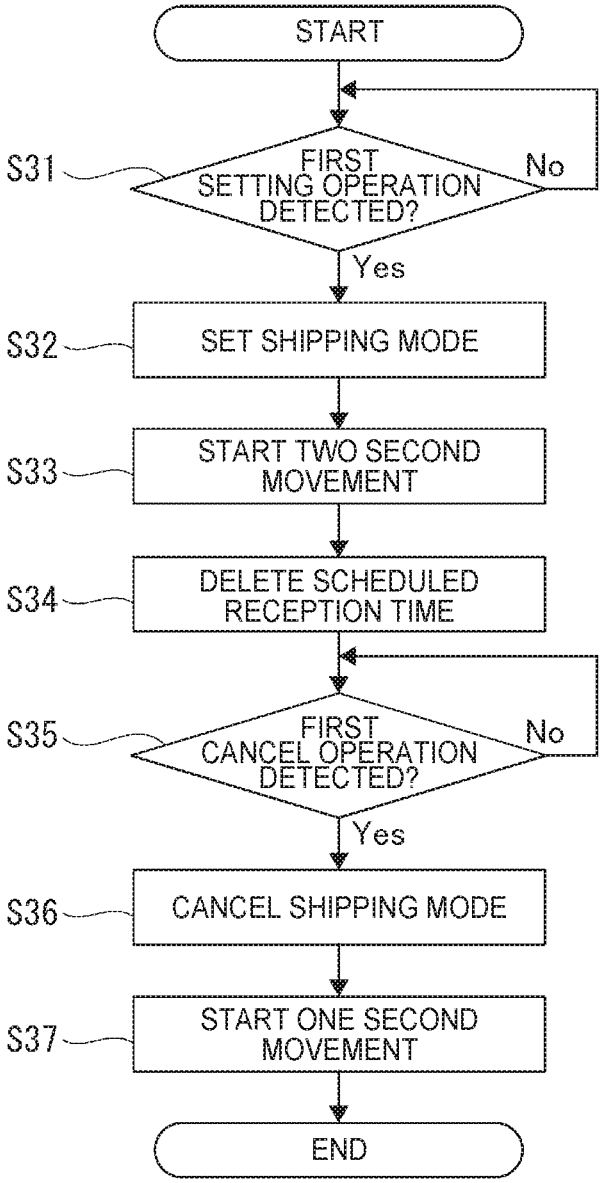
FIG. 8 is a flow chart of the control method for setting and cancelling the shipping mode in the second embodiment of the invention.

The method of controlling setting and cancelling the shipping mode in the second embodiment of the invention is described next based on the flow chart in FIG. 8.

This embodiment differs from the first embodiment in that when the shipping mode is set, the display controller 460 controls the drive mechanism 210 to move the second hand 3B in two second increments. Note that the processes of steps S31, S32, and S34-S36 are the same as the processes of steps S11, S12, and S14-S16 in the first embodiment.

In this embodiment, when the shipping mode is set by the first reception setting module 421 in step S32, the display controller 460 controls the drive mechanism 210 in step S33 to move the second hand 3B in two second increments. In other words, in this embodiment the display controller 460 shows that the shipping mode is set by moving the second hand 3B in two second increments.

When the shipping mode is then cancelled by the first reception setting module 421 in step S36, the display controller 460, in step S37, controls the drive mechanism 210 to start moving the second hand 3B in one second increments. In other words, movement of the second hand 3B returns to the normal movement.

Effect of Embodiment 2

The effect of the second embodiment is described next.

When the shipping mode is set in this embodiment, the display controller 460 controls the drive mechanism 210 to move the second hand 3B in two second increments. As a result, the user can easily know that the shipping mode is set because the second hand 3B is moving differently from the normal movement. The electronic timepiece 1 being used with the automatic reception function disabled can therefore be prevented. Therefore, the incorrect time being displayed because the electronic timepiece 1 is unable to receive time and is unable to update the internal time can therefore be prevented.

The user can also tell the time when the shipping mode is set in this embodiment because the hands 3B to 3D and hands 791, 792 continue to move and indicate the time.

Embodiment 3

A third embodiment of the invention is described next with reference to accompanying figures.

Note that the construction of the electronic timepiece 1 according to this embodiment is the same as the first and second embodiments described above, and further detailed description thereof is therefore omitted.

Method of Controlling Setting and Cancelling the Shipping Mode

Figure 9:
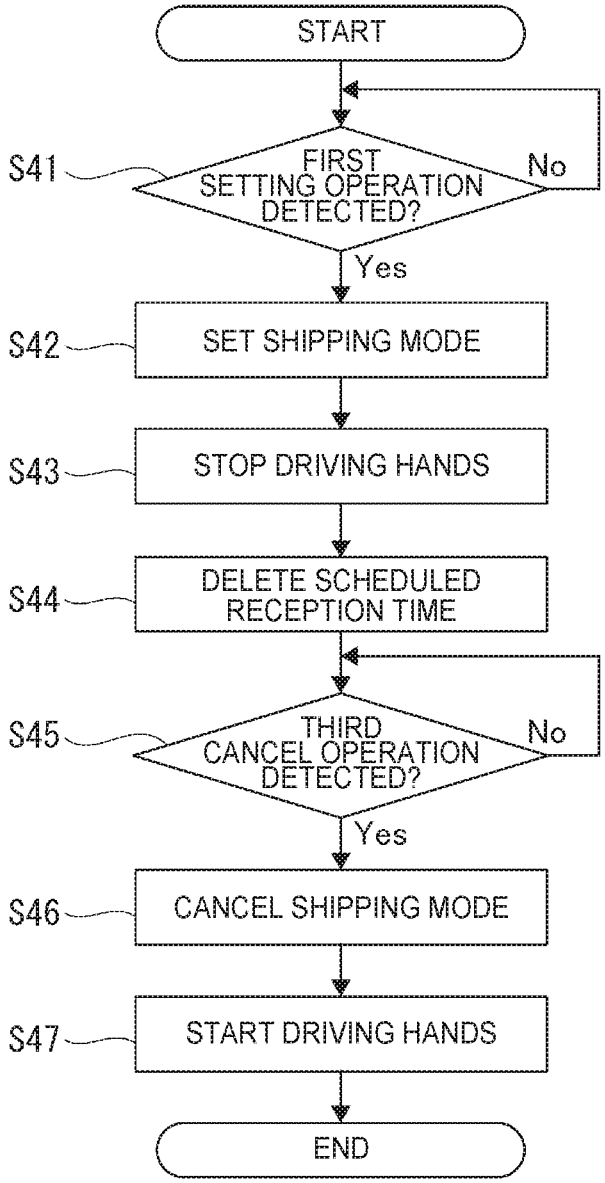
FIG. 9 is a flow chart of the control method for setting and cancelling the shipping mode in the third embodiment of the invention.

The method of controlling setting and cancelling the shipping mode in the electronic timepiece 1 according to the third embodiment of the invention is described next based on the flow chart in FIG. 9.

This embodiment differs from the first embodiment in that when the shipping mode is set, the first reception setting module 421 cancels the shipping mode only when the A button 71 is pushed.

More specifically, when the shipping mode is set in this embodiment, the first reception setting module 421 does not cancel the shipping mode when the crown 6 and B button 72 are operated. Note that the process of steps S41-S44, and S46, S47 is the same as the process of steps S11-S14, and S16, S17 in the first embodiment. More specifically, in step S43 in this embodiment, the display controller 460 controls the drive mechanism 210 to stop the hands 3B to 3D at the positions indicating 10:08:42, and stop the hands 791, 792 at positions indicating 10:08.

Note that as in the first embodiment, the display controller 460 is not limited to stopping all of hands 3B to 3D and hands 791, 792 when the shipping mode is set, and may stop driving at least one of the multiple hands 3B to 3D and hands 791, 792. The positions at which driving the hands 3B to 3D and hands 791, 792 stops are also not limited to the positions described above, and driving the hands 3B to 3D and hands 791, 792 may be stopped at their positions when the shipping mode is set.

In this embodiment the first reception setting module 421 determines in step S45 whether or not a third cancel operation was executed by the input device 70. More specifically, the first reception setting module 421 determines whether or not the A button 71 of the input device 70 was operated. This embodiment therefore determines whether or not a specific button of the input device 70, the A button 71 in this example, was operated.

When step S45 returns No, the first reception setting module 421 repeats the evaluation process of step S45 until the third cancel operation is executed on the input device 70.

When step S45 returns Yes, the first reception setting module 421 cancels the shipping mode in step S46.

Effect of Embodiment 3

The effect of the third embodiment is described next.

As in the first embodiment, because the display controller 460 in this embodiment also stops driving the hands 3B to 3D and hands 791, 792 when the shipping mode is set, the electronic timepiece 1 being used with the automatic reception function disabled can be prevented. Therefore, the electronic timepiece 1 being unable to receive time information to adjust the internal time, and the internal time being incorrect, can be prevented.

The shipping mode is also cancelled in this embodiment when a specific button, the A button 71 in this example, is operated. As a result, cancelling the shipping mode is more difficult than when the shipping mode is cancelled by operating any one of the crown 6, A button 71, and B button 72 as in the first and second embodiments. The shipping mode being accidentally cancelled by vibrations, for example, during shipping from the factory can therefore be prevented.

Other Embodiments

The invention is not limited to the configurations of the embodiments described above, and can be varied in many ways without departing from the scope of the invention as described in the accompanying claims.

In the foregoing embodiments the first setting operation for setting the shipping mode requires more operations of the input device 70 than the second setting operation for setting the airplane mode, but the invention is not so limited. For example, the number of operations of the input device 70 may be the same in the first setting operation and the second setting operation.

The operating time of the first setting operation may also be longer than the second setting operation. For example, the second setting operation may be an operation of the A button 71 being pushed for three seconds or more and less than six seconds, and the first setting operation may be an operation of the A button 71 being pushed for six seconds or more. Because this makes the first setting operation for setting the shipping mode more difficult than the second setting operation for setting the airplane mode, the user can be prevented from accidentally setting the shipping mode.

When determining whether or not the first cancel operation was executed, the first reception setting module 421 in the foregoing embodiments determines whether or not the crown 6 was pulled out or the A button 71 or B button 72 was pushed, but the invention is not so limited. For example, when determining whether or not the first cancel operation was executed, the first reception setting module 421 may determine whether or not any of multiple operating buttons was pushed without determining if the crown was pulled out. In addition, when rotation of the crown at the zero stop position can be detected, the first reception setting module 421 may determine whether or not the crown was pulled out or the crown was turned.

The foregoing embodiments are described as receiving satellite signals containing time information from GPS satellites 100, but the invention is not so limited. For example, satellite signals carrying time information may be received from satellites in other Global Navigation Satellite Systems (GNSS) such as Galileo (EU), GLONASS (Russia), or BeiDou (China), SBAS or other geostationary satellites or quasi-zenith satellites.

The invention is also not limited to receiving time information from satellite signals, and may receive signals according to other standards such as Bluetooth®, BLE (Bluetooth Low Energy), Wi-Fi®, NFC (Near Field Communication), and LPWA (Low Power Wide Area).

The dial 11 in the foregoing embodiments has three subdials, a first subdial 770, second subdial 780, and third subdial 790 in the embodiments, but the invention is not so limited. The invention can also be applied to electronic timepieces having one or more of the three subdials, and electronic timepieces having no subdials.

In the embodiments described above the first reception setting module 421 sets the shipping mode based on operation of the A button 71, but the invention is not so limited and may set the shipping mode based on operation of the crown 6 or B button 72, for example.

The first reception setting module 421 may also be configured to set the shipping mode prohibiting operation of the automatic reception controller 411 when the receiver 30 receives a signal transmitted from a specific location such as a factory. Because this configuration enables the shipping mode to be set only in areas where a signal transmitted from a specific location can be received, the user can be prevented from accidentally setting the shipping mode.

In addition, because the first reception setting module 421 sets the shipping mode when a specific signal is received, the task required for a worker to set the shipping mode before shipping from the factory can be simplified and productivity improved.

When the shipping mode is set in the second embodiment, the display controller 460 controls the drive mechanism 210 to move the second hand 3B in two second increments, but the invention is not so limited. For example, the display controller 460 may move the second hand 3B in five second increments, and that the shipping mode is set can be indicated by moving the hand at a longer interval than during normal operation of the movement.

A display may also be provided on the dial 11, and setting of the shipping mode may be shown on the display.

The invention also includes configurations in which the display controller 460 controls the drive mechanism 210 to move multiple hands that indicate the time normally even when the shipping mode is set. Because the shipping mode is also cancelled in this configuration when any of the crown 6, A button 71, and B button 72 is operated without the user needing to perform an intentional operation, the electronic timepiece being used with the automatic reception function turned off can be prevented.

In the third embodiment the shipping mode is cancelled when a specific button, the A button 71 in this embodiment, is operated, but the invention is not so limited. For example, the shipping mode may be cancelled when any of the operating buttons is operated, that is, when an operator of the input device 70 other than the crown 6 is operated. Further alternatively, the shipping mode may be cancelled only when the crown 6 is operated.

The electronic timepiece of the invention is also not limited to a wristwatch, and may be used in portable devices having a device with high power consumption and a timekeeping mechanism, such as cell phones and mobile GPS receivers that are used when hiking, for example.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An electronic timepiece comprising:

a timekeeper configured to keep an internal time;

a receiver configured to receive time information;

an operating device including an operating button and a crown;

an automatic reception controller configured to determine whether or not an automatic reception condition of the time information is met, and operate the receiver to execute a reception process if the automatic reception condition is met;

a time adjuster configured to adjust the internal time based on the time information received by the receiver;

a reception setter configured to selectively set one of a first automatic reception prohibition mode and a second automatic reception prohibition mode that prohibit operation of the automatic reception controller, multiple hands indicating time;

a driver configured to drive the multiple hands; and a display controller configured to control the driver, the display controller being configured to control the driver to stop driving one hand of the multiple hands when the first automatic reception prohibition mode is set, the display controller being configured to control the driver to drive the multiple hands to indicate the time when the second automatic reception prohibition mode, wherein the first automatic reception prohibition is configured to be cancelled by a plurality of cancellation methods, one of the plurality of cancellation methods is a single operation of the crown, and another of the plurality of cancellation methods is a single operation of the operating button, and the second automatic reception prohibition mode if configured to be cancelled by one predetermined cancellation method.

2. The electronic timepiece described in claim 1, wherein the operating device includes multiple operating buttons, and the first automatic reception prohibition mode is cancelled when any one of the multiple operating buttons is pushed.

3. The electronic timepiece described in claim 1, wherein the first automatic reception prohibition mode is cancelled when the crown is turned or when the crown is pulled out.

4. The electronic timepiece described in claim 1, wherein the first automatic reception prohibition mode is cancelled when the operating button is pushed or when the crown is pulled out.

5. The electronic timepiece described in claim 1, wherein the one predetermined cancellation method is an operation in which the crown is pulled out and an operation in which the operating button is pushed.

6. The electronic timepiece described in claim 1, wherein the reception setter sets the first automatic reception prohibition mode when a first setting operation is executed by the operating device, and sets the second automatic reception prohibition mode when a second setting operation is executed by the operating device, and the first setting operation requires more operations of the operating device than the second setting operation.

7. The electronic timepiece described in claim 1, wherein the reception setter sets the first automatic reception prohibition mode based on an operation of only the operating button.

8. The electronic timepiece described in claim 1, wherein the display controller is configured to control the driver to stop one hand at a predetermined position wherein the first automatic reception prohibition mode is set.

9. The electronic timepiece described in claim 1, wherein the automatic reception condition includes a state in which illuminance of light incident to the electronic timepiece exceeds a specific threshold.

10. The electronic timepiece described in claim 1, further comprising:

a scheduled reception time storage configured to store a scheduled reception time, wherein the automatic reception condition includes a state in which the internal time matches with the scheduled reception time.

11. The electronic timepiece described in claim 10, further comprising:

a manual reception controller configured to operate the receiver to execute a manual reception process when an operating to start manual reception is executed by the operating device, wherein the scheduled reception time storage is configured to store the internal time when the manual reception process was successful as the scheduled reception time at a time in which the manual reception process of the manual reception controller is successful, and the reception setter is configured to delete the scheduled reception time stored in the scheduled reception time storage when the first automatic reception prohibition mode is set.

* * * * *